United States Patent [19]

Henshaw, Jr.

[11] Patent Number: 4,863,394

[45] Date of Patent: Sep. 5, 1989

[54] ELECTRICAL CONNECTOR WITH DOUBLE TORSION CONTACTS

[75] Inventor: Wallace H. Henshaw, Jr., Trumbull, Conn.

[73] Assignee: General Electric Company, Bridgeport, Conn.

[21] Appl. No.: 181,083

[22] Filed: Apr. 13, 1988

Related U.S. Application Data

[63] Continuation of Ser. No. 632,367, May 20, 1985, abandoned.

[51] Int. Cl.[4] ..... H01R 33/08

[52] U.S. Cl. ..... 439/239; 439/834

[58] Field of Search ..... 439/239, 830–833, 439/834

[56] References Cited

U.S. PATENT DOCUMENTS

| | | | |
|---|---|---|---|
| 2,748,363 | 5/1956 | Despard | 339/258 C |
| 3,188,599 | 6/1965 | Roberts | 339/17 |
| 3,639,887 | 2/1972 | Johnson et al. | 339/53 |
| 3,828,299 | 8/1974 | Johnson et al. | 439/239 |
| 4,061,940 | 12/1977 | Fitzgerald et al. | 339/52 |
| 4,218,106 | 8/1980 | Belokin, Jr. | 339/50 R |

FOREIGN PATENT DOCUMENTS

| | | | |
|---|---|---|---|
| 263965 | 3/1964 | Australia | 339/53 |
| 257955 | 4/1964 | Australia | 339/50 |

*Primary Examiner*—Eugene F. Desmond

*Attorney, Agent, or Firm*—Hedman, Gibson, Costigan & Hoare

[57] ABSTRACT

An electrical connector having a pair of opposed torsion blades that are twisted toward each other that provides double torsional contact action when a contact pin is inserted therein for reliably maintaining the contact pin between the blades. An electrical socket for a bi-pin fluorescent lamp is provided having a pair of contact chambers and a double torsion blade connector mounted in each chamber.

9 Claims, 2 Drawing Sheets

TORSION CONTACTS

This is a continuation of U.S. application Ser. No. 632,367 filed May 20, 1985, now abandoned.

FIELD OF THE INVENTION

This invention relates to an electrical connector and more particularly to a pair of electrical connectors, each having a one piece opposing torsional action type electrical contact for accepting and retaining a pin of a bi-pin fluorescent lamp while allowing easy removal of the lamp therefrom.

1. Background of the Invention

In general, electrical connectors for bi-pin fluorescent lamps are positioned in holders or sockets, and provide the connection to a source of electricity for operation of the lamps.

Conventional electrical connectors include those of the single blade type. In operation, turning or rotation of the lamp to make the requisite contact between the pins and the blade is commonly required. At times, this may be difficult to accomplish and can cause damage to the lamp holder or the pins of the lamp.

Also available are connectors of the double blade type. Generally, the blades are planar and are separated by a slit. In operation, insertion of a pin of the bi-pin lamp moves each pair of blades apart, whereupon electrical contact is made. With the planar type of blades, however, accidental withdrawal of the pin from the blades may occur, resulting in the unintentional displacement of the lamp from the holder or socket. Conversely, the lamp insertion and withdrawal forces may be so great as to present a lag and to our individual standarding on a ladder performing the relamping process.

Thus, there is a need for an electrical connector and lamp holder which readily accepts and reliably retains a lamp, such as a bin-pin fluorescent lamp, in a lamp fixture while allowing easy removal of the lamp when desired.

2. Summary of the Invention

In accordance with the present invention, there is provided a new and unique one piece double action torsion connector that readily and reliably retains a contact pin of a lamp in place while allowing easy removal thereof when desired. The torsion connector of the invention includes a thin electrical conductor having a section with a pair of blades separated along the longitudinal axis of the connector, and the blades are offset or twisted from such axis to partially face one another. In use, a pin of a lamp is inserted between the connector blades causing the blades to torsionally twist about their longitudinal axis to accommodate the insertion of the pin and then to partially return to their offset position to secure the pin therebetween. By the relatively high force and contact surface, the double acting torsional blades also provide excellent wiping action for removing contamination and foreign film from each contact pin that is harmful to a low voltage electrical connection. When it is desired to remove the lamp, the pin easily can be withdrawn from the blades.

In a preferred embodiment, a pair of electrical connectors of the invention are housed in a socket or lampholder for a bi-pin fluorescent lamp. The socket includes a housing having a pair of chambers for a pair of electrical connectors, wherein each chamber has an open end portion for receiving a contact pin of the lamp, an opposing end portion for receiving wire which conducts electricity for operation of the lamp, and an intermediate portion having means for positioning the electrical connector in the chambers.

Each electrical connector includes a pair of the described torsion blades at one end section thereof positioned lengthwise in the corresponding open end portion of the chamber, a pressure locking contact section at the other end of the connector for contacting the wire positioned lengthwise in the corresponding opposing portion of the chamber, and an intermediate section engaged by the means in the intermediate portion of the chamber for positioning and holding the electrical connector within the lamp holder.

In use, a contact pin of the bi-pin fluorescent lamp is moved into the open end of each chamber and between the torsional blades of each connector, causing the blades to torsionally twist about their longitudinal axis and to partially return to their offset position to accommodate and secure the pin therebetween. When desired, the lamp is removed from the socket by simply withdrawing the pins from the offset connector blades

BRIEF DESCRIPTION OF THE DRAWINGS

The following is a detailed description together with accompanying drawings of preferred embodiments of the invention. It is to be understood that the invention is capable of modification and variation apparent to those skilled in the art within the spirit and scope of the invention.

DETAILED DESCRIPTION OF THE INVENTION

Figure 1A:
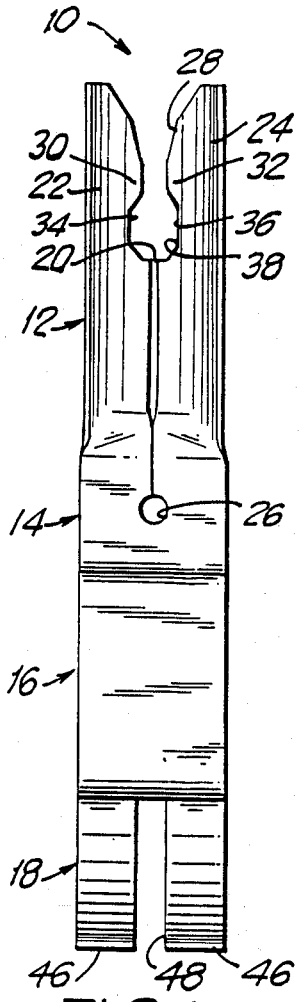
FIG. 1*a* is a rear elevational view of a preferred embodiment of the electrical connector of the present invention.
Figure 2:
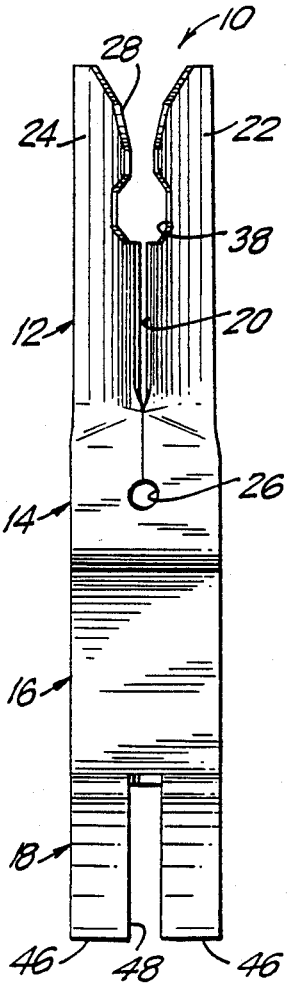
FIG. 2 is a front elevational view of the electrical connector of FIG. 1.

Referring now to the drawings and particularly to FIGS. 1–3 there is shown a preferred embodiment of the torsion connector 10 which includes a contact section 12, an intermediate planar section 14 and U-shaped mounting section 16, and a pressure locking contact section 18.

The torsion connector 10 is made of a single piece of conducting metal and is of a thin blade construction.

The contact section 12 has a slit 20 along the longitudinal axis forming a pair of torsion blades 22, 24. The slit 20 extends partially into the intermediate section 14, terminating at aperture 26. The torsion blades 22, 24 are twisted toward each other in a V-shaped relative to each other as better seen in FIG. 1*b*. Accordingly, the planes of the torsion blades 22, 24 are offset from the plane of the intermediate section 14. However, even though these sections are offset, it can be seen that the contact and intermediate sections have one common longitudinal axis. Therefore, as will be explained more fully below, when a contact pin is inserted between the blades 22, 24, a torsional effect is produced from the section 12 to the section 14.

Figure 1B:
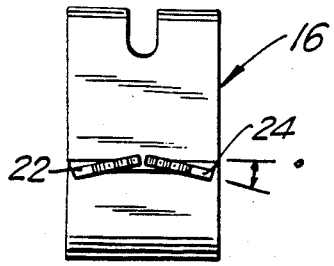
FIG. 1*b* is a plan view of the electrical connector of FIG. 1*a*.

As mentioned above, the plane of the intermediate section 14 is offset from the planes of the blades 22, 24. The number of degrees the sections are offset depends on a number of variable factors, including the material used in constructing the connector 10, the thickness and width of the connector 10, and the torsional twist desired and the size of the mating contact pin. The optimum range of offset has been found to be between 10° and 45°. In the embodiment shown in the FIGURES, the offset is 20° as indicated in FIG. 1*b*.

To permit a contact pin to be inserted between blades 22, 24 there is provided an opening 28 at the free end of the contact section 12. The blades 22, 24 include opposed bevel portions 30, 32 projecting toward each other at a point below the opening 28. Immediately below the bevel portions 30, 32, the blades 22, 24 have opposed indentations 34, 36 which define pin engaging aperture 38.

Figure 6:
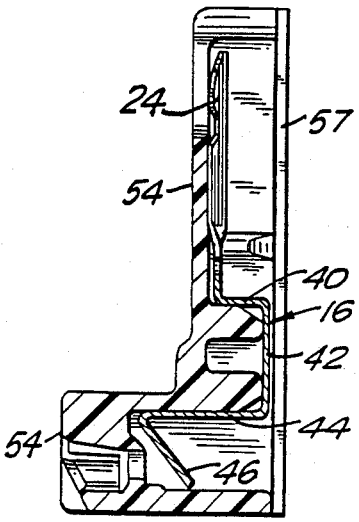
FIG. 6 is a sectional view of FIG. 5 taken along lines 6—6 thereof.

As shown in FIG. 6, the U-shaped mounting section includes upper leg 40, central leg 42 and lower leg 44. Referring again to FIG. 1*a*, the pressure locking section 18 includes locking prongs 46 separated by slit 48.

Figure 3A:
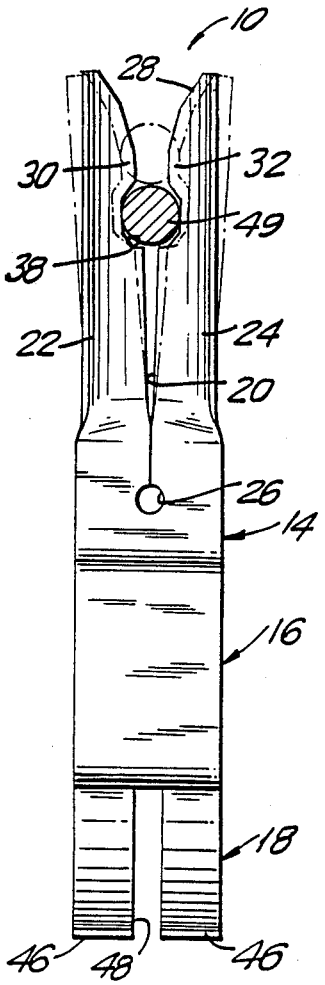
FIG. 3*a* is a rear elevational view of the electrical connector of FIG. 1*a* wherein a pin of a lamp has been inserted between the pair of torsional blades.
Figure 3B:
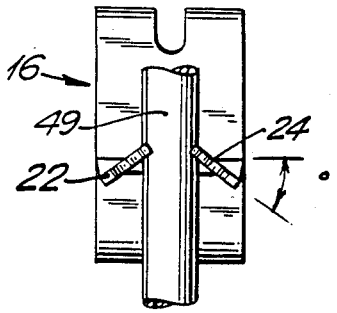
FIG. 3*b* is a plan view of FIG. 3*a*.
Figure 4:
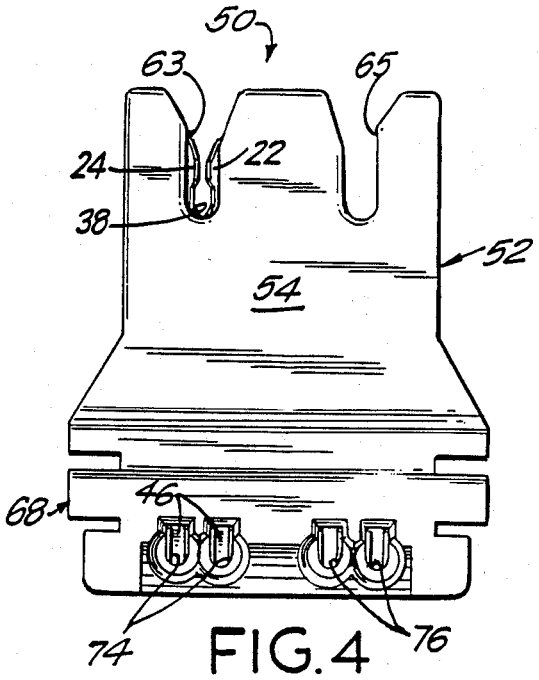
FIG. 4 is a front elevational view of a lamp holder or socket of the present invention.

Looking at FIG. 3*a* and 3*b*, as the contact pin 49 is inserted into the opening 28 the pin 49 contacts the bevel portions 30, 32 and twists the blades 22, 24 about their longitudinal axis thereby torsionally displacing the blades 22, 24. This initial double torsional displacement is shown in phantom in FIG. 3*a*. Thereafter, the pin 49 is further inserted between the blades 22, 24, and is fully seated in the aperture 38. When the contact pin 49 is fully seated, the blades 22, 24 partially return to their offset position thereby reducing some of the torsional forces. However, as shown in FIG. 3*b*, the blades 22, 24 retain sufficient twist over and above that shown in FIG. 1 to provide the superior torsional forces to reliably maintain the contact pin 49 in the seated position. The double torsional action provides the excellent wiping action necessary to insure a proper electrical connection. The angle of torsional displacement of the blades 22, 24 when the pin 39 is fully seated is dependent on the size of the pin and is generally in the range between .090 inches diameter and .105 inches diameter. In the application shown in FIGS. 3*a* and 3*b* the angle of displacement is 20°. The relative movement of the blades 22, 24 with respect to the intermediate section 14 having the common longitudinal axis provides stability during the twisting action and greatly increases the reliability of the connector 10 during use. Furthermore, the unique design enables the connector 10 to be easily and economically manufactured.

In a preferred embodiment, the connector 10 is mounted in an electrical socket as the bi-pin fluorescent lamp socket 50 shown in FIGS. 4–7. The socket 50 includes housing 52 having a front wall 54. As viewed, from the rear in FIG. 5 the housing 52 further includes side walls 56, 58 and intermediate wall 60 defining a pair of contact chambers 62, 64. The socket 50 further includes a removable rear wall 57 having apertures 59 that align with cavities 61 in intermediate wall 60. A suitable securing device such as a mounting clip or screws (not shown) is inserted through the apertures 59 and is maintained in the cavities 61 for securing the rear wall 57 to the socket 50. Chambers 62, 64 include slotted openings 63, 65, respectively in front wall 54. Each chamber includes a pair of opposed bosses 67, 69 projecting from the side walls 56, 58 and intermediate wall 60. The bosses 67, 69 insure location for the blades 22, 24 relative to the slotted openings 63 and 65. An intermediate transverse rib extends between the side walls 56, 58 and intermediate wall 60 as a means for mounting the connector 10 in the chambers 62, 64.

The housing 52 also includes a wire receiving section 68 having a pair of contact locking recesses 70, 72. Each of the recesses 70, 72 includes a pair of conductor receiving passageways 74, 76 that extend through the front wall 54 and a separating rib 77 extending from the inner side of front wall 54. The housing 52 is also provided with grooves 78 for mounting the lampholder in the metal enclosure of an electric lighting fixture.

Figure 5:
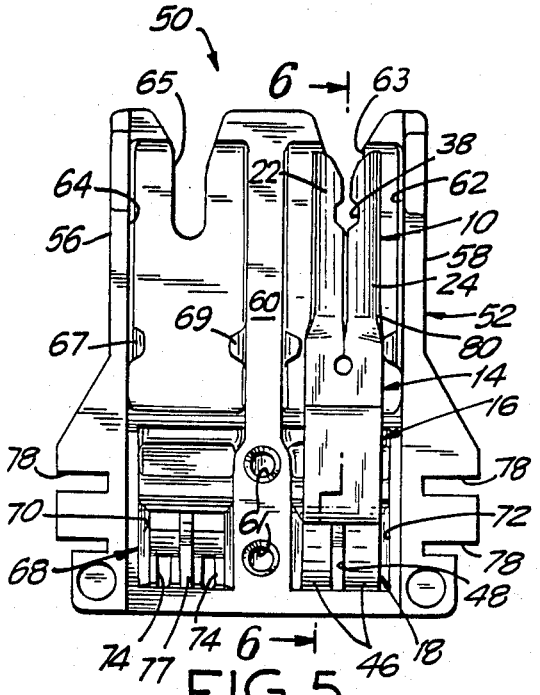
FIG. 5 is a rear elevational view of the socket of FIG. 4 with its rear wall removed to illustrate the chambers of the socket and an electrical connector of the present invention positioned in one of the chambers.
Figure 7:
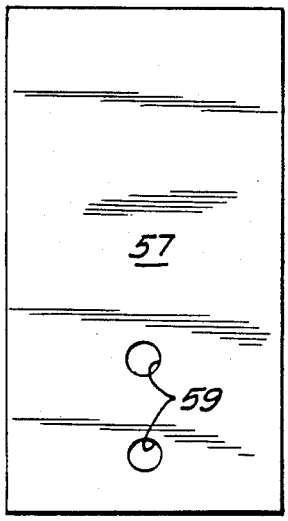
FIG. 7 is a longitudinal elevational view of the rear wall cover for the socket of FIG. 5.

A torsion connector 10 is mounted in each of the chambers 62, 64 with the blades 22, 24 extending lengthwise in each chamber 62, 64 and in the pin engaging aperture 38 aligned with the slotted openings 63 and 65. The apex of the V formed by the blades 22, 24 is pointing toward the slotted openings 63, 65. The side edges 80 of the connector 10 engage the bosses 67, 69 in the chambers 62, 64. The housing 52 is shown in FIG. 5 with one torsion connector 10 mounted therein for example purposes only.

The U-shaped mounting section 16 rests on and covers the transverse rib 66. Referring to FIG. 6 it can be seen that the upper leg 40, the central leg 42 and the lower leg 44 grips the transverse rib to hold the connector 10 in the chamber 64. The insulating rear wall 57 provides additional assurance that the connector 10 will remain in place.

The pressure locking contact section 18 extends into the recess 72 at an angle away from the front wall 54 as shown in FIG. 6. The locking prongs 46 are aligned with and cover the conductor passageways 76 and straddle the separating rib 77. Thus, when a conductor is inserted through the passageway 76, it will engage and push the locking prong 46 toward the rear of housing 50, while slipping under locking prong 46. The locking prong 46 will exert downward pressure on the conductor preventing the conductor from being removed.

The combination of the torsion connector 10 housed in the socket 50 is an excellent electrical lampholder for a bi-pin fluorescent lamp that provides a double electrical connection to each lamp pin and a mechanical force that accepts and retains the lamp in the proper position in a lamp fixture while allowing easy lamp removal.

In operation, a lamp having a bi-pin connector on each end is inserted into socket 50 by inserting the pins through the slotted openings 63, 65 to contact the torsion connector 10. Both pins may be inserted at the same time thus avoiding the turning required by the single blade connectors. The pins will then contact the blades 22, 24 of each connector 10 and the double torsional displacement described above will occur as the pins pass through the opposed bevel portions 30, 32 and seat in the apertures 38. During this displacement the blades 22, 24 will initially twist away from the front wall 54 of the housing 52 and thereafter as the pin is fully seated in the aperture 38, the blades 22, 24 will partially return to the offset position. Thus, superior torsional forces are provided to retain the lamp pins in the socket 50.

While preferred embodiments of the subject invention have been described and illustrated, it is obvious that various changes and modifications can be made therein without departing from the spirit of the present invention which should be limited only by the scope of the appended claims.

I claim:

1. An electrical connector, of thin blade construction for removably accepting a contact pin or the like comprising:

a contact section at one end of the connector and a planar section connected to said contact section, said section being substantially aligned along a common longitudinal axis thereto said contact section having a slit along its longitudinal axis forming a pair of torsion blades, said torsion blades being arranged to define an opening in the contact section of said connector, said opening being formed by opposed beveled portions on each of said torsion blades, said torsion blades having opposed indentations that define a contact pin engaging aperture, said opening being sized to permit insertion of a contact pin along the axis of said slit, said torsion blades having opposed bevel portions angled in a V-shaped, whereby the planes of said torsion blades and said planar section are angled toward each other at a point below said opening which permit said blades to twist about the longitudinal axis of said slit when a contact pin is inserted between said blades thereby exerting torsional forces on said contact pin to reliably maintain the contact pin in engagement with said blades, said connector also having a U-shaped mounting section connected to said planar section.

2. The electrical connector of claim 1 further including a pressure locking contact section for electrical conductors, said pressure locking contact section being connected to said U-shaped mounting section.

3. A torsion connector of thin blade construction for accepting a contact pin or the like of a lamp said connector comprising:

a contact section at one end of the connector having a slit along the longitudinal axis of said contact section forming a pair of torsion blades, said torsion blades being arranged to define an opening in the contact section of said connector, said opening being formed by opposed beveled portions on each of said torsion blades, said torsion blades having opposing indentations therein spaced from the contact section at the end of said connector to define a pin engaging aperture, said opening being sized to permit insertion of a contact pin along the axis of said slot;

a planar intermediate section connected to said contact section that is adjacent to said pin engaging aperture and being substantially aligned along a common longitudinal axis, said slit extending partially into said planar intermediate section; and said torsion blades being twisted in a V-shaped relative to each other whereby the planes of said torsion blades and the planar intermediate section are offset such that when a contact pin is inserted between said torsion blades, said torsion blades will twist about the longitudinal axis of said slit thereby exerting torsional forces on the contact pin to reliably maintain the contact pin in engagement with said blades said torsion blades have a cross-section having an edge, which touches a contact pin which is inserted between said torsion blades, said connector also having a U-shaped mounting section connected to said planar section.

4. In an electrical socket for receiving a contact pin of a lamp said electrical socket having a housing with a chamber therein and an open end into which the contact pin can extend, a torsion connector comprising:

a contact section at one end of the connector and a planar section connected to said contact section, said section being substantially aligned along a common longitudinal axis having a slit along the longitudinal axis of said contact section forming a pair of torsion blades, said torsion blades being arranged to define an opening in the contact section of said connector, said opening being formed by opposed beveled portions on each of said torsion blades, said torsion blades having opposing indentations therein spaced from the outer end of said contact section to define a pin engaging aperture said opening being sized to permit insertion of a contact pin along the axis of said slot;

a planar intermediate section connected to the inner end of said contact section that is adjacent to said pin engaging aperture and being substantially aligned about a common longitudinal axis, said slit extending partially into said planar intermediate section; and said torsion blades being twisted in a V-shaped relative to each other whereby the planes of said torsion blades and the planar intermediate section are offset such that when a contact pin is inserted between said blades, said blades will twist about the longitudinal axis of said slit thereby exerting torsional forces on the contact pin to reliably maintain the contact pin in engagement with said blades; said torsion connector extending lengthwise in the chamber and being aligned with said open end in said housing said connector also having a U-shaped mounting section connected to said planar section.

5. The electrical socket of claim 4, wherein said housing further includes a transverse rib at a point spaced from said opening, and wherein said connector further includes a U-shaped mounting section connected to said contact section and resting on and covering said transverse rib.

6. The electrical socket of claim 5, wherein the housing further includes a wire receiving section opposite its open end having a pair of passageways through which electrical conductors extend and wherein the torsion connector further includes a pressure locking contact section in said wire receiving section and being aligned with the passageways for contact with the wires extending therethrough.

7. An electrical socket for bi-pin fluorescent lamps comprising:

a housing having a front wall, opposed side walls and an intermediate wall defining a pair of contact chambers therein, said front wall having a pair of slotted openings at one end thereof for receiving contact pins in said chambers;

a transverse rib extending between said side walls and said intermediate wall of said housing at a point spaced from the slotted openings;

a wire receiving section in said housing, opposite said slotted opening at one end, including a pair of contact locking recesses aligned with said contact chambers, each of said recesses having a pair of conductor receiving passageways through said front wall and a separating rib attached to the inner side of said front wall and extending into said recesses; an electrical connector in said housing which comprises a contact section at the end of the connector and a planar section connected to said contact section, said sections being substantially aligned along a common longitudinal axis thereto, said contact section having a slit along its longitudinal axis forming a pair of torsion blades, said torsion blades being arranged to define an opening in the contact section of said connector, said opening being formed by opposed beveled portions of each of said torsion blades, said torsion blades having opposed indentations that define a contact pin engaging aperture, said opening being sized to permit insertion of a contact pin along said longitudinal axis of said slit when a contact pin is inserted between said blades thereby exerting torsional forces on said contact pin to reliably maintain the contact pin in engagement with said blades, said connector also having a U-shaped mounting section connected to said planar section; said U-shaped mounting section resting on and covering said transverse rib of said housing and said electrical connector having attached to the end of said U-shaped mounting section that is opposite said planar section a pressure locking contact section, said pressure locking contact section having a slit defining a pair of locking prongs extending into said contact locking recess away from said front wall, said locking prongs being positioned on either side of said transverse rib and aligned with said conductor receiving passageways.

8. A torsion connector of thin blade construction for accepting the contact pin of a bi-pin fluorescent lamp, said torsion connector comprising:

a contact section at one end of said connector and a planar section connected to said contact section, said sections being substantially aligned along a common longitudinal axis, said contact section having a slit along its longitudinal axis forming a pair of torsion blades, said torsion blades being arranged to define an opening in the contact section of said connector, said opening being formed by opposed beveled portions on each of said torsion blades, said torsion blades having opposing indentations therein spaced to define a pin engaging aperture, said opening being sized to permit insertion of a contact pin along the axis of said slit;

a planar intermediate section connected to the inner end of said contact section that is adjacent to said pin engaging aperture and being substantially aligned along a common longitudinal axis, said slit extending partially into said planar intermediate section; and said torsion blades being twisted in a V-shape at an angle of 20° relative to each other whereby the planes of said torsion blades and the planar intermediate section are offset such that when a contact pin is inserted between said blades, said blades will twist along the longitudinal axis of said slit thereby exerting torsional forces on the contact pin in engagement with said blades.

9. A torsion connector as defined in claim 8 wherein a contact pin of a fluorescent lamp has been placed in said contact section and said torsion blades exert torsional forces on said contact pin.

* * * * *